US005973548A

United States Patent [19]

Ukita et al.

[11] Patent Number: 5,973,548

[45] Date of Patent: Oct. 26, 1999

[54] INTERNAL SUPPLY VOLTAGE GENERATING CIRCUIT FOR GENERATING INTERNAL SUPPLY VOLTAGE LESS SUSCEPTIBLE TO VARIATION OF EXTERNAL SUPPLY VOLTAGE

[75] Inventors: Motomu Ukita; Yoshiyuki Ishigaki, both of Hyogo, Japan

[73] Assignee: Mitsubishi Denki Kabushiki Kaisha, Tokyo, Japan

[21] Appl. No.: 08/873,022

[22] Filed: Jun. 11, 1997

[30] Foreign Application Priority Data

Jan. 7, 1997 [JP] Japan ..... 9-000612

[51] Int. Cl.[6] ..... G05F 1/10

[52] U.S. Cl. ..... 327/540; 327/541; 327/543

[58] Field of Search ..... 327/540, 541, 327/543; 323/313, 315

[56] References Cited

U.S. PATENT DOCUMENTS

| | | | |
|---|---|---|---|
| 4,475,050 | 10/1984 | Noufer | 326/71 |
| 4,585,955 | 4/1986 | Uchida | 327/541 |
| 4,649,291 | 3/1987 | Konishi | 327/541 |
| 4,857,769 | 8/1989 | Kotera et al. | 327/541 |
| 5,021,691 | 6/1991 | Saito | 327/543 |
| 5,097,303 | 3/1992 | Taguchi | 357/23.6 |
| 5,128,556 | 7/1992 | Hirakata | 327/541 |
| 5,448,199 | 9/1995 | Park | 327/546 |
| 5,451,896 | 9/1995 | Mori | 327/543 |
| 5,467,052 | 11/1995 | Tsukada | 327/543 |
| 5,552,740 | 9/1996 | Casper | 327/541 |
| 5,568,084 | 10/1996 | McClure et al. | 327/538 |
| 5,638,330 | 6/1997 | Confalonieri et al. | 365/189.09 |
| 5,682,117 | 10/1997 | Choi et al. | 327/530 |
| 5,757,225 | 5/1998 | Tobita | 327/539 |

FOREIGN PATENT DOCUMENTS

| | | |
|---|---|---|
| 3-207091 | 9/1991 | Japan . |
| 7-78470 | 3/1995 | Japan . |

*Primary Examiner*—Timothy P. Callahan
*Assistant Examiner*—An T. Luu
*Attorney, Agent, or Firm*—McDermott, Will & Emery

[57] ABSTRACT

An internal voltage generating circuit down-converts an external supply voltage and changes a reduction in its output voltage level from the external supply voltage level as the external supply voltage increases. The internal supply voltage is kept lower than the external supply voltage by the constant value while the external supply voltage stays under a predetermined voltage. The reduction amount is increased in proportion to the external supply voltage while the external supply voltage is over the predetermined voltage.

5 Claims, 17 Drawing Sheets

INTERNAL SUPPLY VOLTAGE GENERATING CIRCUIT FOR GENERATING INTERNAL SUPPLY VOLTAGE LESS SUSCEPTIBLE TO VARIATION OF EXTERNAL SUPPLY VOLTAGE

CROSS-REFERENCE TO RELATED APPLICATIONS

This application is related to co-pending applications of Ser. No. 08/627,169, filed Jun. 27, 1996 and Ser. No. 08/676,596 filed Jul. 3, 1996.

BACKGROUND OF THE INVENTION

1. Field of the Invention

The present invention relates to a circuit for generating internal power supply voltage in a semiconductor memory device.

2. Description of the Background Art

As semiconductor devices are miniaturized, there arises a need to decrease power supply voltage in order to ensure reliability of devices such as transistors. Although a static random access memory (SRAM) has a long life, external supply voltage would remain at 5.0V for sometime in the future. A circuit is required for generating internal supply voltage by decreasing the external supply voltage of 5.0 V. In the SRAM, especially of low power consumption type, the current consumed by the circuit for generating internal supply voltage increases, causing another problem. Accordingly, an internal supply voltage generating circuit which consumes less current or no current has been proposed.

FIG. 30 is a circuit diagram showing a structure of a conventional internal supply voltage generating circuit (voltage down converter) for an SRAM. As shown in FIG. 30, the internal supply voltage generating circuit is constituted by an N channel MOS transistor NT1 having its source, drain, and gate respectively connected to an internal supply node 31, an external supply node 30, and drain.

FIG. 31 shows an operation of the conventional internal supply voltage generating circuit shown in FIG. 30. When external supply voltage Vcc is supplied to external supply node 30, voltage as shown by the line 32 is generated on internal supply node 31 if the supplied voltage is not decreased. Voltage which is actually generated is equal to Vcc−Vth (NMOS) which is smaller than Vcc by threshold voltage Vth (NMOS) of the N channel MOS transistor NT1 as shown by the broken line.

It is noted that the threshold voltage Vth (NMOS) is increased since backgate voltage (potential difference between backgate and source) is increased by the increase of voltage from 0 V on the source of N channel MOS transistor NT1.

According to the current process for SRAM of 5 V supply voltage normally utilized, threshold voltage Vth (NMOS) is 0.7 V when the backgate voltage is 0 V. When voltage of 5.0 V is supplied to external supply node 30 of N channel MOS transistor NT1 shown in FIG. 30, voltage on internal supply node 31 is around 3.5 V. In this case, backgate voltage is −3.5 V and threshold voltage Vth (NMOS) is about 1.5 V.

In the internal supply voltage generating circuit shown in FIG. 30, an amount of decrease in voltage is determined as about 1.5 V. The voltage of 3.5 V obtained by decreasing 5 V by 1.5 V is still too high in the latest wafer process since the miniaturization is highly developed. Although it is possible to increase the amount of decrease in voltage by increasing threshold voltage Vth (NMOS), uniformly increased threshold voltage Vth (NMOS) of N channel NMOS transistors in a chip deteriorates the performance of the device. Further, additional process is needed in order to increase threshold voltage Vth (NMOS) of the N channel MOS transistor used for decreasing voltage, adding cost.

SUMMARY OF THE INVENTION

An object of the present invention is to provide an internal supply voltage generating circuit for generating internal supply voltage which is less susceptible to variation of external supply voltage Vcc over a wide range of voltages, while increasing an amount of decrease in voltage.

According to a first aspect of the invention, an internal supply voltage generating circuit includes: a first N channel MOS transistor connected between an external supply node and an internal supply node; at least one first resistance element connected between the external supply node and the gate of the first N channel MOS transistor; and at least one diode element connected between the gate of the first N channel MOS transistor and a ground node.

According to another aspect of the invention, an internal supply voltage generating circuit is provided in a semiconductor memory device which includes a first internal supply node for supplying voltage to peripheral circuits, and a second internal supply node for supplying voltage to memory cells. The internal supply voltage generating circuit includes: a first N channel MOS transistor connected between an external supply node and a first internal supply node; a first resistance element connected between the external supply node and the gate of the first N channel MOS transistor; at least one first diode element connected in series between the gate of the first N channel MOS transistor and a ground node; a second N channel MOS transistor connected between the external supply node and a second internal supply node; a second resistance element connected between the external supply node and the gate of the second N channel MOS transistor; at least one second diode element connected in series between the gate of the second N channel MOS transistor and the ground node; a first P channel MOS transistor connected between the external supply node and the second internal supply node; a second P channel MOS transistor connected between the external supply node and the gate of the first P channel MOS transistor; a third resistance element connected between the gate of the first P channel MOS transistor and the ground node; a fourth resistance element connected between the external supply node and the gate of the second P channel MOS transistor; and a fifth resistance element connected between the gate of the second P channel MOS transistor and the ground node.

An advantage of the present invention is, therefore, that the amount of decrease in voltage can be made small at the side of lower voltages while the amount of decrease in voltage can be made large at the side of higher voltages, since the gate of the N channel MOS transistor is controlled by external supply voltage divided by the resistance element and the diode element.

Another advantage of the present invention is that, at higher voltage, the amount of decrease in voltage of the memory cell can be made different from that of the peripheral circuit, and internal supply voltage supplied to the memory cell is made equal to external supply voltage when the external supply voltage is small.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
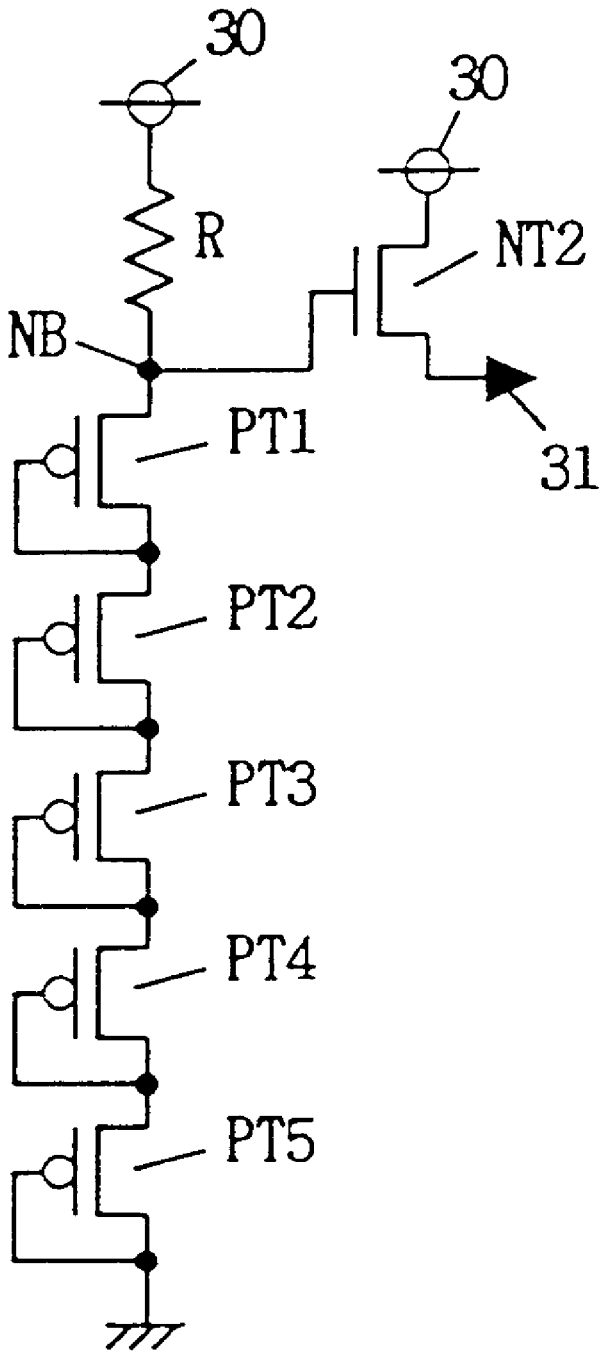
FIG. 1 is a circuit diagram showing a structure of an internal supply voltage generating circuit according to the first embodiment of the invention.

Embodiments of the present invention are hereinafter described in detail with reference to drawings. Like reference characters denote the identical or the corresponding parts in the drawings.

(First Embodiment)

FIG. 1 is a circuit diagram showing a structure of an internal supply voltage generating circuit according to the first embodiment of the invention.

As shown in FIG. 1, the internal supply voltage generating circuit includes: an N channel MOS transistor NT2 connected between external supply node 30 and internal supply node 31; resistance element R connected between external supply node 30 and the gate of N channel MOS transistor NT2; and five P channel MOS transistors PT1–PT5 diode connected in series between the gate of N channel MOS transistor NT2 and ground node. The gate of the N channel MOS transistor for decreasing voltage is controlled by resistance element R and P channel MOS transistors PT1–PT5 connected in series in five stages.

Figure 2A:
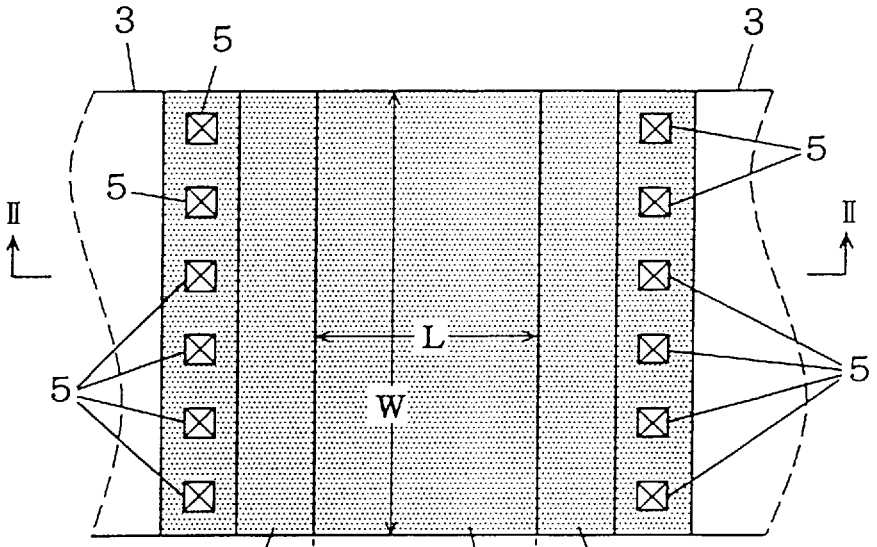
FIG. 2A is a plan view illustrating the structure of the resistance element shown in FIG. 1.
Figure 2B:
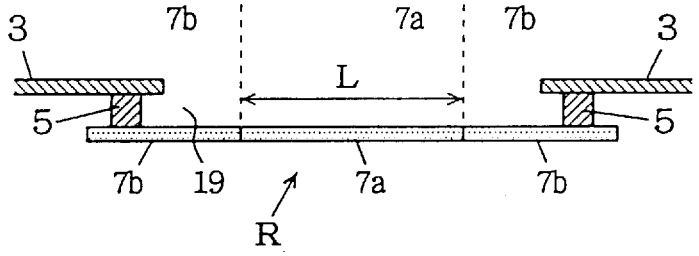
FIG. 2B shows the structure of the cross section thereof.

FIG. 2A is a plan view showing a structure of a high resistance element of polysilicon conventionally utilized as resistance element R of FIG. 1. FIG. 2B is a cross sectional view taken along a line II of FIG. 2A.

With reference to FIGS. 2A and 2B, the polysilicon high resistance element used as resistance element R is formed of a metal interconnection 3, a contact hole 5 and a polysilicon 7. Polysilicon 7 is formed of a polysilicon (resistance portion) 7*a* and polysilicon (interconnection portion) 7*b*. Polysilicon (interconnection portion) 7*b* is connected to metal interconnection 3 via contact hole 5 formed at an insulating film 19 such as an oxide film. In contact hole 5, a conductive layer such as of metal is formed.

A polysilicon resistance as resistance element R is thus produced by connecting polysilicon 7 to metal interconnection 3 via contact hole 5.

Generally, the resistance value of polysilicon (resistance portion) 7*a* is proportional to its length L, and inversely proportional to its width W. In other words, the resistance value of polysilicon (resistance portion) 7*a* is determined by the ratio of length L to width W, i.e. L/W.

In SRAM of recent years, the thin film transistor (TFT) is utilized as the load of the memory cell instead of the polysilicon high resistance element described above.

Figure 3A:
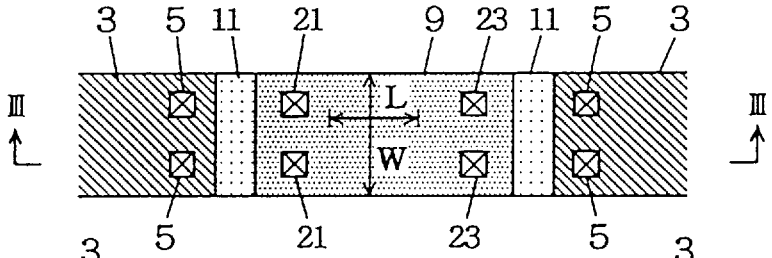
FIG. 3A is a plan view illustrating a structure of TFT used as the resistance element shown in FIG. 1.
Figure 3B:
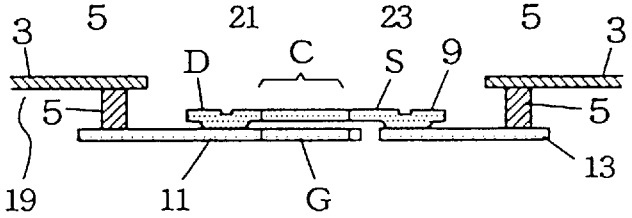
FIG. 3B illustrates the structure of the cross section thereof.
Figure 3C:
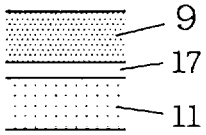
FIG. 3C is an enlarged view of the portion of channel C in FIG. 3B.

FIG. 3A is a plan view of TFT, and FIG. 3B is a cross sectional view taken along a line III in FIG. 3A. FIG. 3C is an enlarged view of the channel C shown in FIG. 3B.

Referring to FIGS. 3A, 3B, and 3C, TFT is constituted by polysilicons 9, 11, and a gate insulating film 17. Polysilicon 9 is used as drain D, channel C and source S. A part of polysilicon 11 is gate G. Gate insulating film 17 is, for example, a gate oxide film. When TFT is used as resistance element R, metal interconnection 3, contact holes 5, 21, 23, polysilicons 9, 11, 13 and gate insulating film 17 are considered as one unit.

As shown in FIG. 3C, gate insulating film 17 is formed on polysilicon 11. Polysilicon 9 is formed on gate insulating film 17. Drain D of polysilicon 9 and polysilicon 11 is connected via contact hole 21. A conductive layer of polysilicon is formed in contact hole 21.

Source S of polysilicon 9 is connected to polysilicon 13 via contact hole 23. A conductive layer is formed in contact hole 23 by polysilicon. Polysilicon 11 is connected to metal interconnection 3 via contact hole 5 formed at insulating film 19. A conductive layer is formed in contact hole 5 by metal. Polysilicon 13 is connected to metal interconnection 3 via contact hole 5 formed at insulating film 19. Insulating film 19 is, for example, an oxide film. Control of the resistance value of the TFT described above is difficult, since the resistance value differs by three orders or more between on state and off state.

Figure 4A:
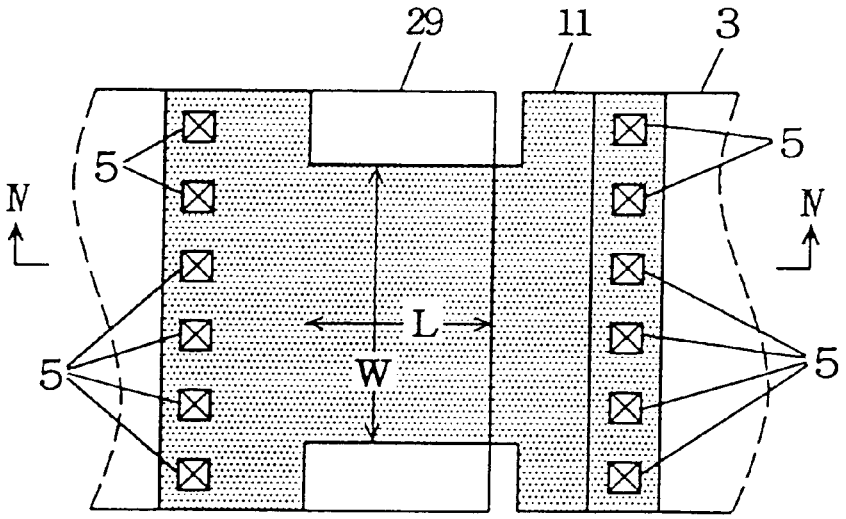
FIG. 4A is a plan view showing the structure of TFT having its gates of aluminum interconnection used as the resistance element shown in FIG. 1.
Figure 4B:
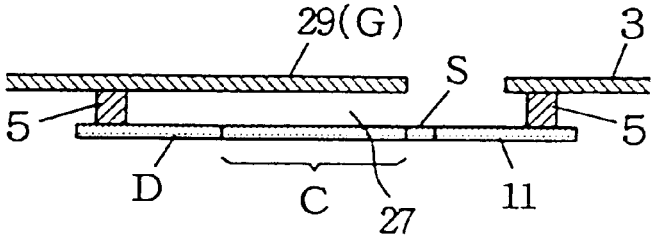
FIG. 4B illustrates the cross sectional structure thereof.

If resistance element R having a medium resistance value is desired, the TFT shown in FIGS. 4A and 4B having its gate of aluminum interconnection can be used. FIG. 4A is a plan view, and FIG. 4B is a cross sectional view taken along a line IV of FIG. 4A.

The TFT is formed of a metal interconnection 29, a gate insulating film 27, and polysilicon 11. A portion of metal interconnection 29 is used as gate G. Polysilicon 11 is used as drain D, channel C and source S.

When TFT is utilized as resistance element R, the TFT is considered to include contact hole 5 and metal interconnection 3.

Gate insulating film 27 is formed on polysilicon 11. Gate insulating film 27 is, for example, a gate oxide film. Metal interconnections 3, 29 are formed on gate oxide film 27. Metal interconnections 3, 29 are, for example, aluminum interconnections. Contact hole 5 is formed at gate insulating film 27. Metal interconnections 3, 29 are connected to polysilicon 11 via contact hole 5. In contact hole 5, a conductive layer is formed. The conductive layer is, for example, metal such as aluminum. Channel C has a width of W and a length of L.

Gate insulating film 27 is made thick by using metal interconnection 29 as a gate electrode G. The thickness of gate insulating film 27 is 2000–5000 Å. The resistance value of TFT in on state can be set at a few hundreds MΩ which is suitable when the TFT is utilized as resistance element R in the internal supply voltage generating circuit. The TFT having its gate of aluminum interconnection utilizes aluminum process which is originally employed for interconnection, so that additional process is not required. Further, the thickness of gate insulating film 27 is substantially increased compared with that of the normal TFT, so that decrease of the resistance value in off state and increase of the resistance value in on state can be achieved, and the medium resistance value can be used.

Figure 5:
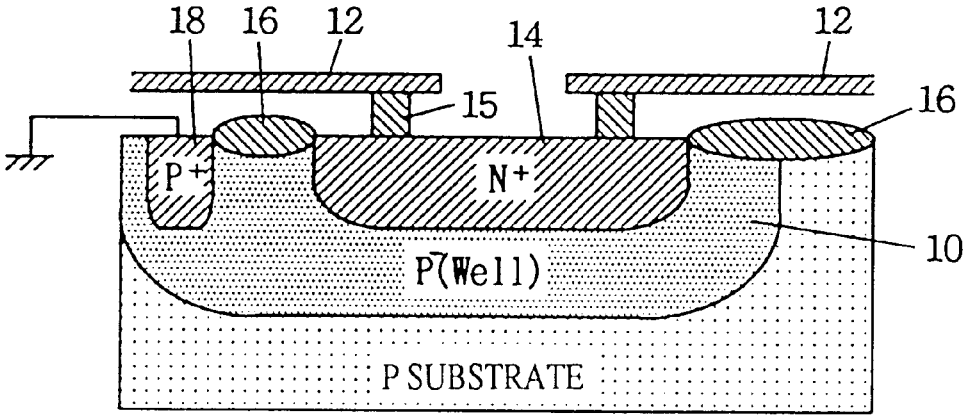
FIG. 5 shows a structure of a high resistance element utilizing $N^+$ active region.

FIG. 5 illustrates a structure of a high resistance element which employs $N^+$ active region. As shown in FIG. 5, the high resistance element includes: $P^-$ well 10 in a P substrate; a $P^+$ layer 18 and $N^+$ layer 14 in $P^-$ well 10; a field oxide film 16; a metal interconnection 12; and a contact hole 15. Metal interconnection 12 is connected to $N^+$ layer 14 via contact hole 15.

The high resistance element which utilizes the active region is less suitable for use in the internal supply voltage generating circuit according to this embodiment because of difficulty in increasing the resistance value.

Figure 6:
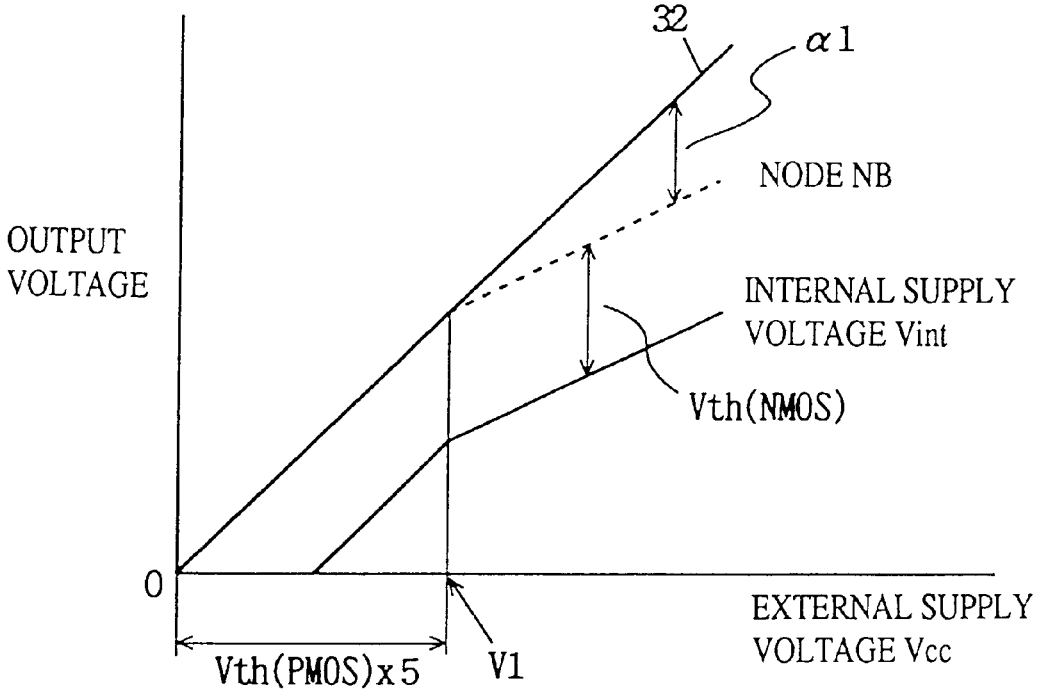
FIG. 6 shows an operation of the internal supply voltage generating circuit of FIG. 1.

Referring to FIG. 6, an operation of the internal supply voltage generating circuit according to the first embodiment is described.

As shown by line 32, internal supply voltage which is to be output is equal to external supply voltage Vcc as described above.

When voltage on external supply node 30 (external supply voltage Vcc) is less than the threshold voltage of the P channel MOS transistor Vth (PMOS) multiplied by five (V1), P channel MOS transistors PT1–PT5 are in off state, so that the potential on node NB is identical to external supply voltage Vcc via resistance element R.

Suppose that threshold voltage of the N channel MOS transistor NT2 is Vth (NMOS), then internal supply voltage Vint is equal to voltage Vcc−Vth (NMOS).

On the other hand, if the external supply voltage Vcc is more than the threshold voltage Vth (PMOS) multiplied by five (V1), P channel MOS transistors PT1–PT5 connected in series in five stages are all turned on. As a result, the potential on node NB becomes smaller than external supply voltage Vcc since the voltage is divided by resistance element R and five-stage P channel MOS transistors PT1–PT5. As a result, when the voltage applied to both ends of resistance element R is α1, the potential on node NB is equal to Vcc−α1. Accordingly, internal supply voltage Vint is equal to voltage Vcc−α1−Vth (NMOS).

Since α1 is proportional to the amount of external supply voltage Vcc, the amount of decrease in voltage can be set at threshold voltage Vth (NMOS) at lower voltage side where small reduction in voltage is desired, and the amount of decrease in voltage can be set at voltage Vth (NMOS)+α1 at higher voltage side where large reduction in voltage is desired.

Accordingly, as shown in FIG. 6, internal supply voltage Vint is shown by the line which is bent at voltage VC. When external supply voltage exceeds voltage Vl, variation of external supply voltage affects internal supply voltage Vint only slightly.

The amount of voltage applied to both ends of resistance elements R (α1) can be adjusted by changing the number of stages of P channel MOS transistors. The larger the number of stages, the smaller the amount of decrease in voltage, and the smaller the number of stages, the larger the amount of decrease in voltage.

(Second Embodiment)

Figure 7:
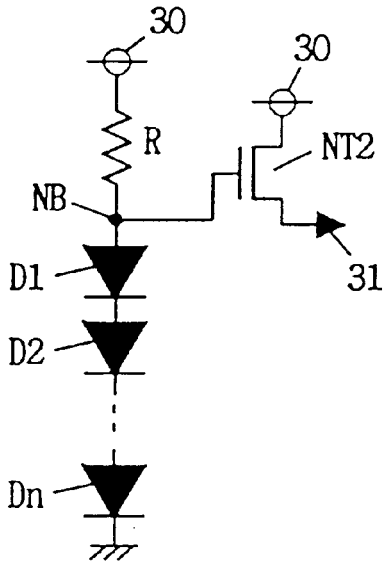
FIG. 7 is a circuit diagram showing a structure of an internal supply voltage generating circuit according to the second embodiment of the invention.

FIG. 7 is a circuit diagram showing a structure of an internal supply voltage generating circuit according to the second embodiment of the invention.

As shown in FIG. 7, the internal supply voltage generating circuit has a structure similar to that of the internal supply voltage generating circuit of FIG. 1, except that diodes D1–Dn are connected in series in n stages between node NB and ground node.

Figure 8:
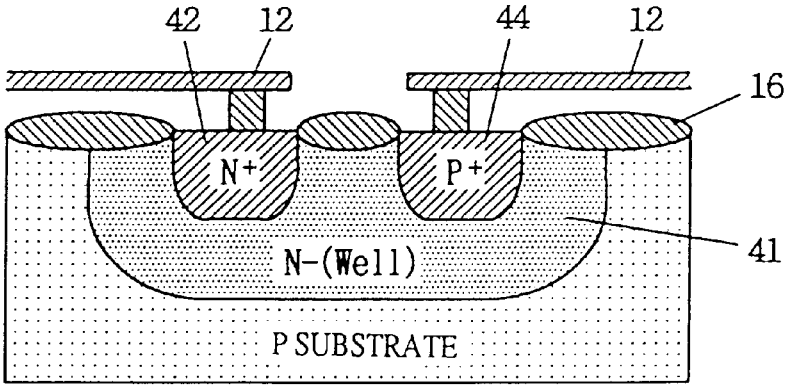
FIG. 8 illustrates the structure of the diode shown in FIG. 7.

FIG. 8 shows a general structure of a diode.

As shown in FIG. 8, the diode includes $N^+$ layer 42 and $P^+$ layer 44 in $N^-$ well 41 connected to metal interconnection 12.

In this diode, current flows in one direction from $P^+$ layer 44 to $N^-$ well 41.

Figure 9:
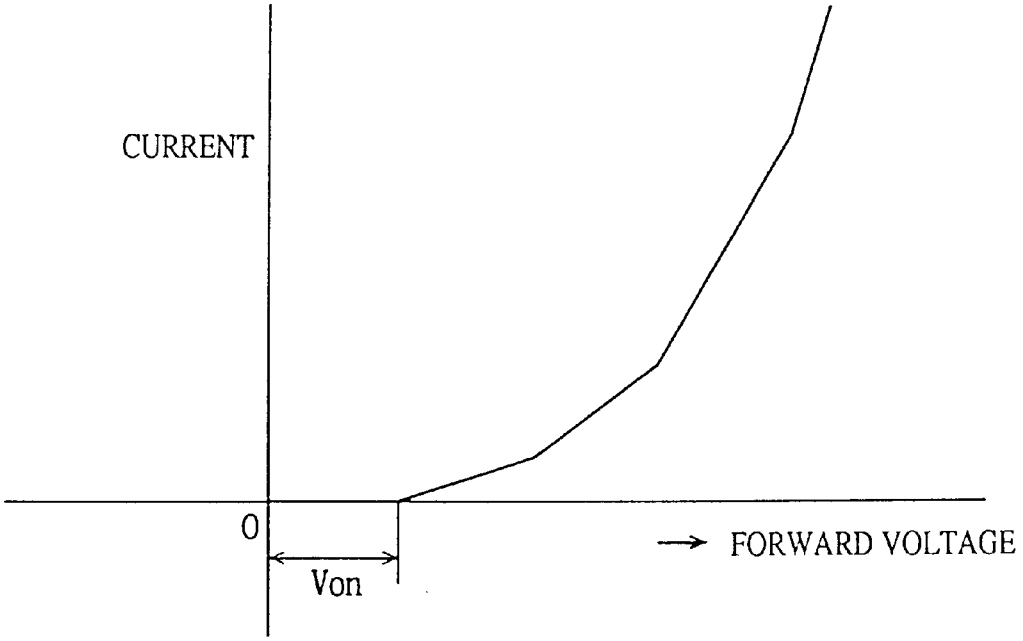
FIG. 9 shows an operation of the diode shown in FIG. 7.

FIG. 9 shows a characteristic of an operation of the diode. FIG. 9 shows that the flowing current rapidly increases when voltage Von is applied in forward direction in the diode.

In the internal supply voltage generating circuit according to the second embodiment, if external supply voltage Vcc is less than Von×n, diodes D1–Dn are not turned on. At this time, the potential on node NB is equal to the potential on external supply node 30, so that voltage Vcc−Vth (NMOS) is generated on internal supply node 31.

On the other hand, if external supply voltage Vcc is equal to Von×n or more, diodes D1–Dn are turned on. As a result, the voltage resistance division of resistance element R and diodes D1–Dn is applied to the gate of N channel MOS transistor NT2, and an operation similar to that of the internal supply voltage circuit according to the first embodiment proceeds. In other words, suppose that the voltage on resistance element R is α, internal voltage Vint to be produced is equal to voltage Vcc- α-Vth (NMOS).

(Third embodiment)

Figure 10:
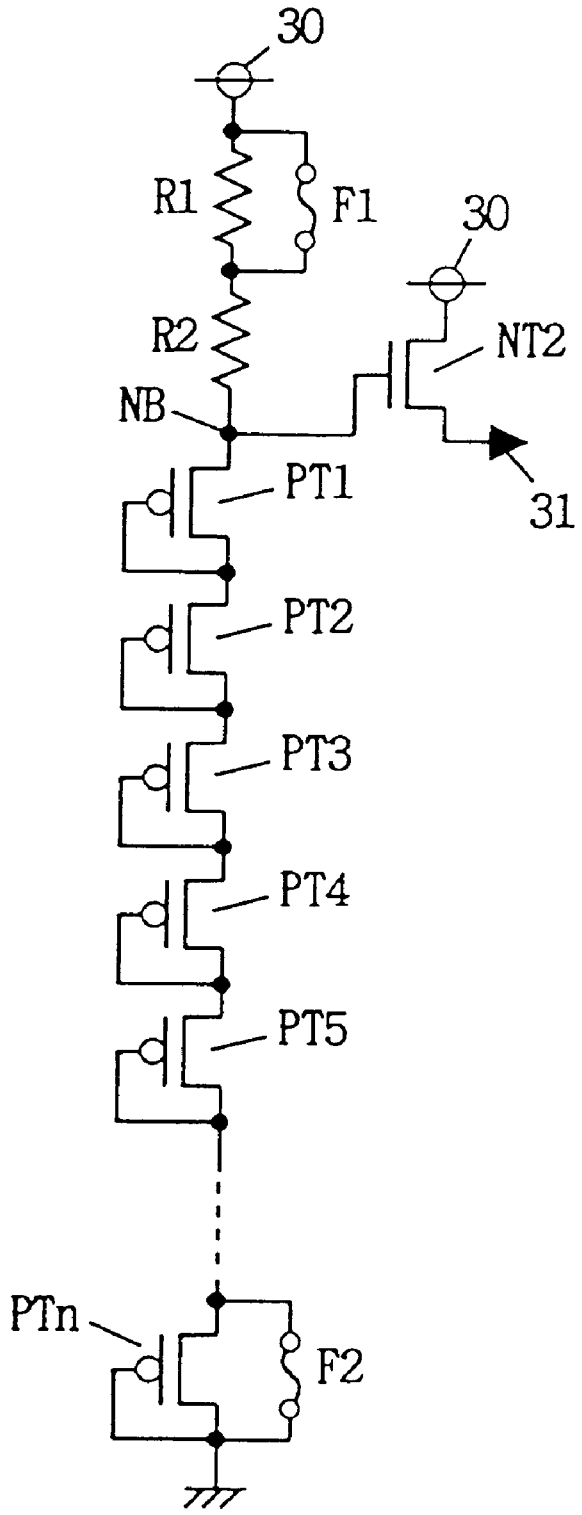
FIGS. 10–13 are circuit diagrams respectively showing the structures of internal supply voltage generating circuits according to the third to the sixth embodiments of the invention.

FIG. 10 is a circuit diagram illustrating a structure of an internal supply voltage generating circuit according to the third embodiment.

As shown in FIG. 10, the internal supply voltage generating circuit has a structure similar to that of the internal supply voltage generating circuit of the first embodiment, except that resistance elements R1 and R2 are connected in series between external supply node 30 and node NB, and a fuse F1 is further provided connected in parallel with resistance element R1. Between node NB and ground node, n stages of P channel MOS transistors PTn are diode connected in series, and a fuse F2 is further provided connected in parallel with P channel MOS transistor PTn.

The amount of decrease in voltage may vary with the completed chip since resistance value of resistance elements R1, R2 as well as threshold voltage Vth (PMOS) of P channel MOS transistor would vary. In order to solve this problem, characteristics of the internal supply voltage generating circuit formed on a wafer are measured, and if the characteristics are not what is desired, the fuse is blown after the wafer process is completed. As a result, the amount of decrease in voltage can be adjusted.

(Fourth Embodiment)

Figure 11:
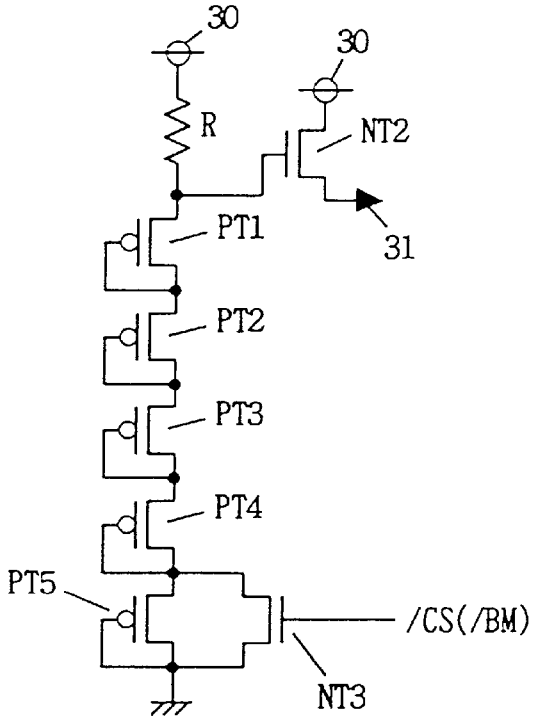

FIG. 11 is a circuit diagram illustrating a structure of an internal supply voltage generating circuit according to the fourth embodiment.

As shown in FIG. 11, the internal supply voltage generating circuit according to the fourth embodiment has a structure similar to that according to the first embodiment, except that an N channel MOS transistor NT3 is further provided connected in parallel between the source and the drain of P channel MOS transistor PT5.

Chip select signal /CS, for example, is supplied to the gate of N channel MOS transistor NT3. In standby state (/CS=H) in which data is just retained and less voltages is required, internal supply voltage can be reduced since N channel MOS transistor NT3 is turned on. When high speed circuit operation is required (/CS=L), N channel MOS transistor NT3 is turned off, so that internal supply voltage can be increased.

Reliability of the chip deteriorates approximately in accordance with the product of the voltage and time. Therefore, the reliability can be improved by decreasing voltage when not much needed. Especially in the SRAM of low power consumption, this operation is effective since standby time is longer compared with operating time.

If a burn-in test signal /BM is supplied to the gate of N channel MOS transistor NT3 instead of chip select signal /CS, internal supply voltage can be made higher than usual at the time of burn-in test (reliability acceleration test) (/BM=L). As a result, good acceleration can be attained for the reliability test and the test time can be reduced.

(Fifth Embodiment)

Figure 12:
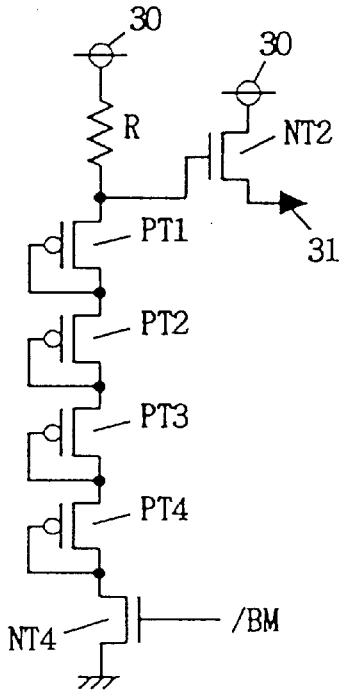

FIG. 12 is a circuit diagram showing a structure of an internal supply voltage generating circuit according to the fifth embodiment.

As shown in FIG. 12, the internal supply voltage generating circuit has a structure similar to that of the first embodiment, except that an N channel MOS transistor NT4 is further provided connected in series with P channel MOS transistor PT4 and receiving at the gate the burn-in test signal (/BM).

In normal operation (/BM=H), N channel MOS transistor NT4 is turned on, and the operation is similar to that according to the first embodiment.

On the other hand, at the time of burn-in test (/BM=L), N channel MOS transistor NT4 is turned off, and external supply voltage Vcc is applied to the gate of N channel MOS transistor NT2.

Accordingly, internal supply voltage Vint to be produced is equal to voltage Vcc−Vth (NMOS), and acceleration of the burn-in test can be improved.

(Sixth Embodiment)

Figure 13:
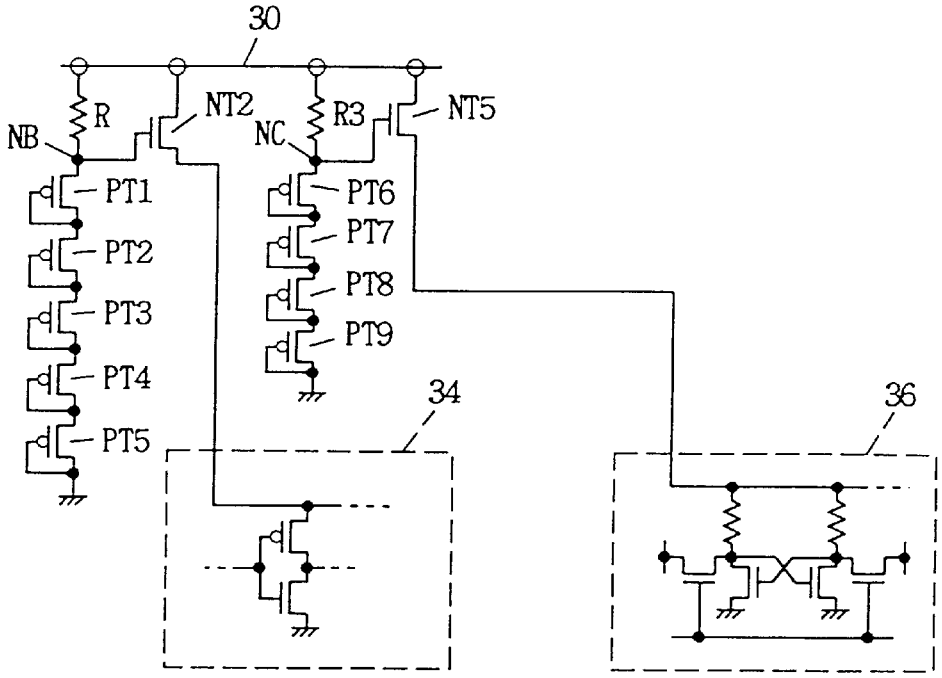

FIG. 13 illustrates a structure of an internal supply voltage generating circuit according to the sixth embodiment of the invention.

As shown in FIG. 13, in the internal supply voltage generating circuit according to the sixth embodiment, the internal supply voltage generating circuit of the first embodiment is provided to each of a peripheral circuit 34 and a memory cell 36.

In the circuit for memory cell 36, P channel MOS transistors PT6–PT9 of four stages are diode connected in series.

Figure 14:
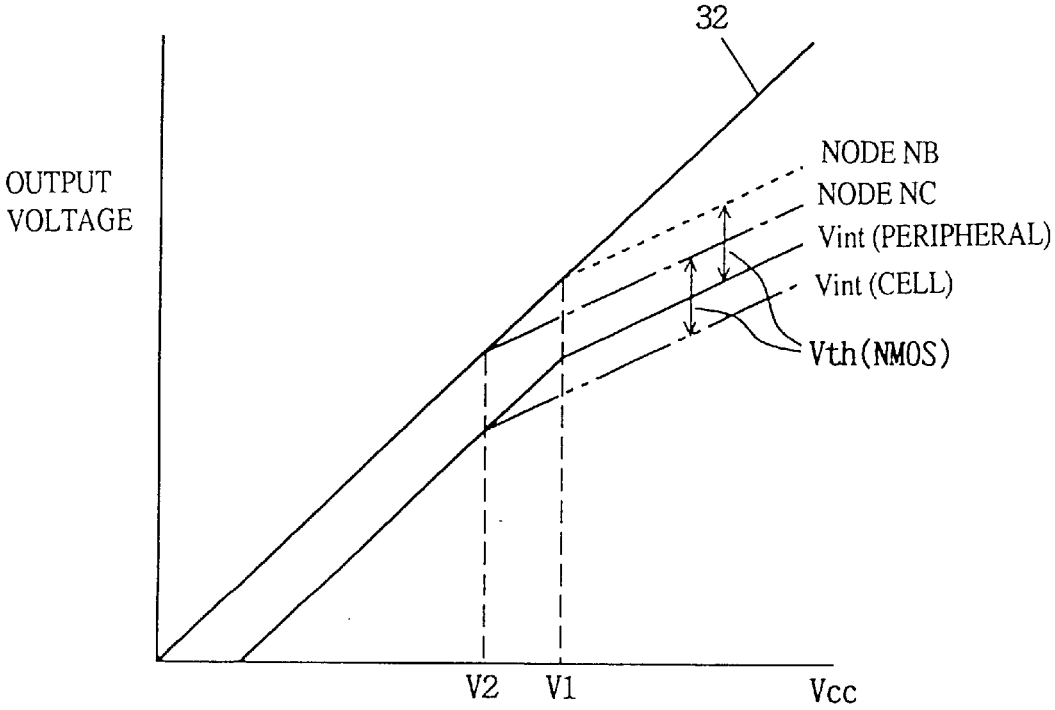
FIG. 14 shows an operation of the internal supply voltage generating circuit shown in FIG. 13.

FIG. 14 shows an operation of the internal supply voltage generating circuit according to this embodiment.

As described above, the number of the stages of P channel MOS transistors PT6–PT9 for memory cell 36 is smaller than that for the peripheral circuit. Therefore, P channel MOS transistors PT6–PT9 are turned on at voltage V2 which is lower than voltage V1 at which P channel MOS transistors PT1–PT5 for peripheral circuit 34 are turned on. As a result, since threshold voltage vth (NMOS) of N channel MOS transistors NT2, NT5 do not change and the potential on node NC is lower than that on node NB when voltage is V2 or more, internal supply voltage applied to memory cell 36 is lower.

The number of stages of P channel MOS transistors in the circuit for memory cell 36 is smaller compared with the circuit for peripheral circuit 34. Accordingly, the amount of decrease in voltage is larger in the circuit for memory cell 36.

According to the internal supply voltage generating circuit of this embodiment, relatively higher internal supply voltage is supplied to peripheral circuit 34 which requires relatively high supply voltage for circuit operation. On the other hand, relatively lower internal supply voltage can be applied to memory cell 36 which requires the minimum voltage for data retention in memory cell 36.

Accordingly, reliability of the device can be improved by decreasing the number of transistors receiving high voltage.

(Seventh Embodiment)

Figure 15:
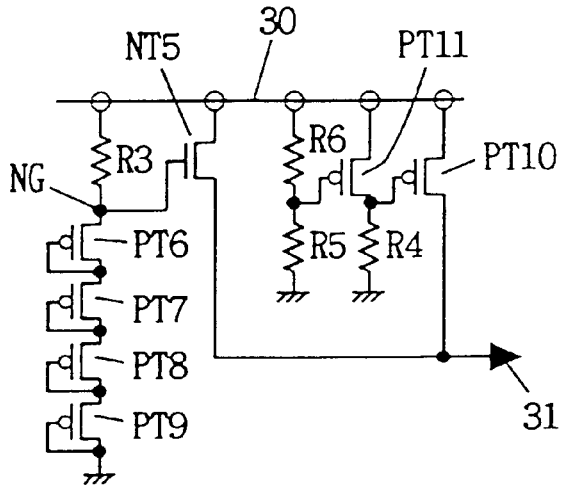
FIG. 15 is a circuit diagram showing a structure of an internal supply voltage generating circuit according to the seventh embodiment of the invention.

FIG. 15 is a circuit diagram illustrating a structure of an internal supply voltage generating circuit according to the seventh embodiment of the invention.

As shown in FIG. 15, the internal supply voltage generating circuit includes, in addition to the internal supply voltage generating circuit of the first embodiment (P channel MOS transistors PT6–PT9 are connected in series in four stages in this embodiment): a P channel MOS transistor PT10 connected between external supply node 30 and internal supply node 31; a resistance element R4 connected between the gate of P channel MOS transistor PT10 and ground node; a P channel MOS transistor PT11 connected between external supply node 30 and the gate of P channel MOS transistor PT10; a resistance element R6 connected between external supply node 30 and the gate of P channel MOS transistor PT11; and a resistance element R5 connected between the gate of P channel MOS transistor PT11 and ground node.

Figure 16:
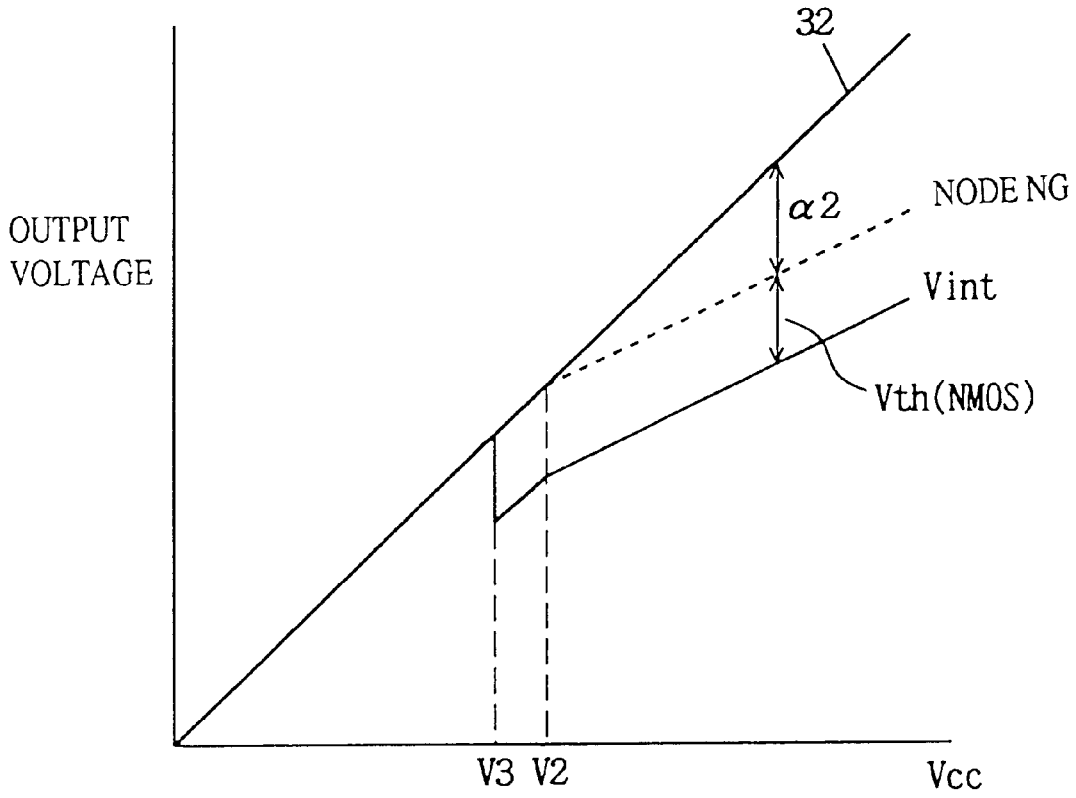
FIG. 16 shows an operation of the internal supply voltage generating circuit shown in FIG. 15.

Next with reference to FIG. 16, an operation of the internal supply voltage generating circuit according to this embodiment is described.

When external supply voltage is low, P channel MOS transistor PT10 is turned on, and external supply node 30 and internal supply node 31 are short circuited.

When external supply voltage rises to reach voltage V3, P channel MOS transistor PT10 is turned off, and internal supply voltage Vint which is output via N channel MOS transistor NT5 is equal to voltage Vcc−Vth (NMOS).

It is noted that voltage V3 is determined by the ratio between resistance R5 and resistance R6.

As described in the first embodiment, when the voltage further rises to reach voltage V2, the potential on node NG becomes smaller than external supply voltage Vcc, and internal supply voltage Vint is equal to voltage Vcc−α2−Vth (NMOS), where α2 is an amount of voltage across both ends of resistance element R3.

Accordingly, internal supply voltage Vint is equal to external supply voltage Vcc when external supply voltage is low, equal to voltage Vcc−Vth (NMOS) when external supply voltage is between voltage V3 and voltage V2, and equal to voltage Vcc−α2−Vth (NMOS) when external power supply voltage exceeds voltage V2.

Therefore, the amount of decrease in voltage is small or 0 at the side of lower voltages (<V2) where the reduced voltage is not advantageous for circuit operation and data retention, and the amount of decrease in voltage is large at the side of higher voltages (>V2) where higher voltage may deteriorate reliability.

(Eighth Embodiment)

Figure 17:
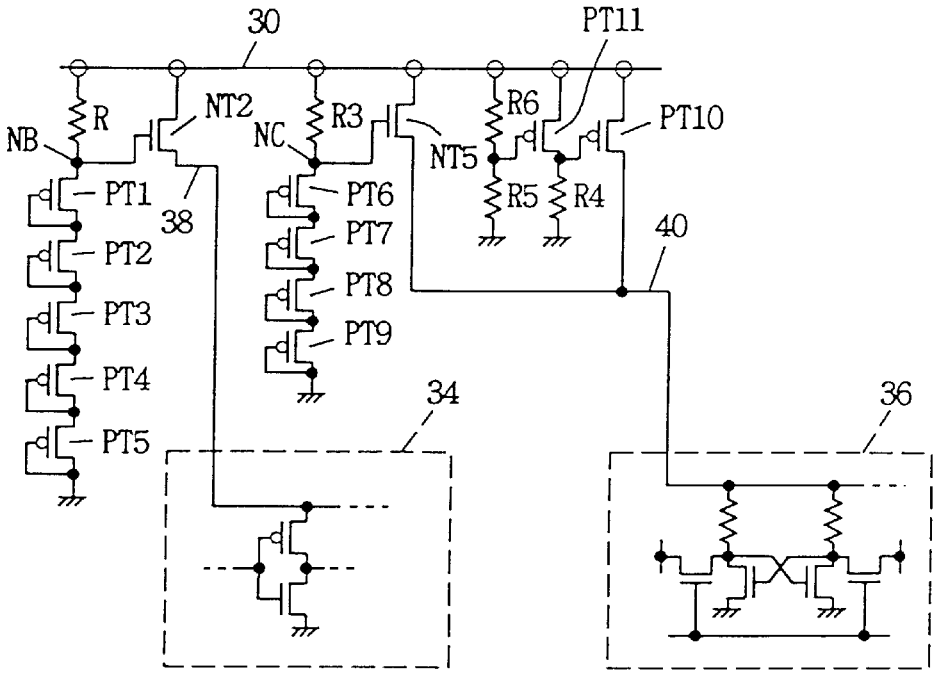
FIG. 17 is a circuit diagram showing a structure of an internal supply voltage generating circuit according to the eighth embodiment of the invention.

FIG. 17 illustrates a structure of an internal supply voltage generating circuit according to the eighth embodiment.

As shown in FIG. 17, the internal supply voltage generating circuit of this embodiment is constituted by a combination of the internal supply voltage generating circuit of the first embodiment connected to a voltage supply node 38 for applying voltage to peripheral circuit 34, and the internal supply voltage generating circuit of the seventh embodiment connected to a voltage supply node 40 for applying voltage to memory cell 36.

Figure 18:
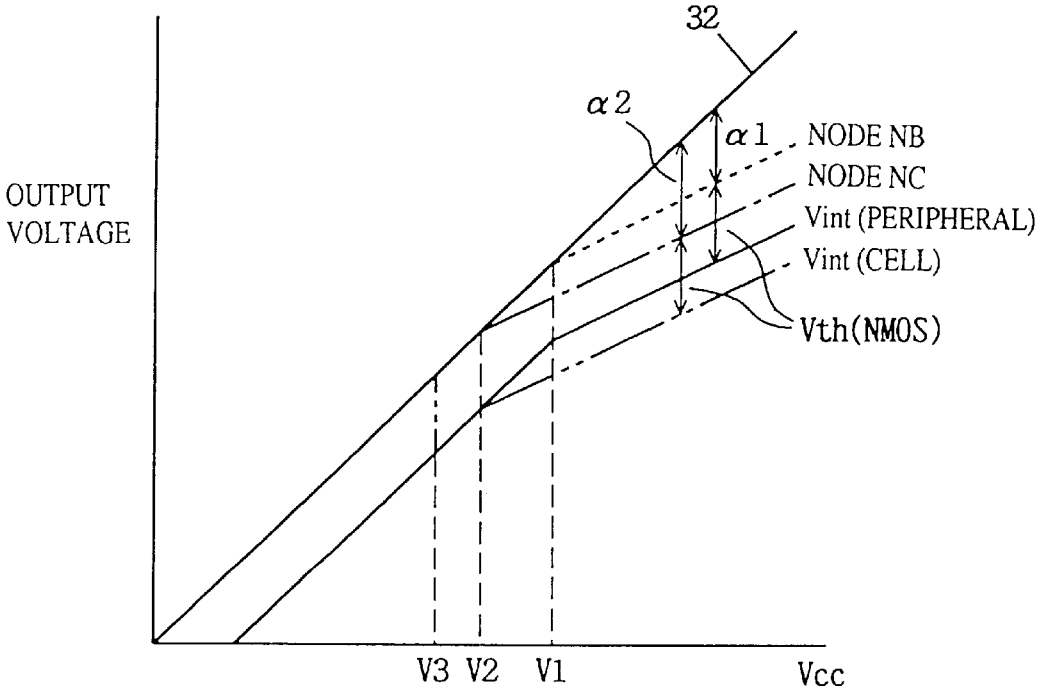
FIG. 18 shows an operation of the internal supply voltage generating circuit in FIG. 17.

FIG. 18 shows an operation of the internal supply voltage generating circuit according to this embodiment.

FIG. 18 shows that this operation is a combination of the operation of the internal supply voltage generating circuits according to the first and the seventh embodiments.

At higher voltages (>V1), internal supply voltage applied to memory cell 36 Vint (cell) is equal to voltage Vcc−α2−Vth (NMOS), and internal supply voltage applied to peripheral circuit 34 Vint (peripheral) is equal to voltage Vcc−α1−Vth (NMOS). The amount of decrease in voltage applied to memory cell 36 is larger than the one supplied to peripheral circuit 34 since voltage α2 is higher than voltage α1.

When external supply voltage is less than voltage V3, internal supply voltage applied to memory cell 36 is equal to external supply voltage Vcc.

As for most of the current SRAMs, external supply voltage is 5 V±0.5 V and the minimum value is 4.5 V, then internal supply voltage and external supply voltage are not required to be the same. However, only the minimum voltage for data retention is 3.0 V. In this case, a desired internal supply voltage is 3.0 V which is equal to external supply voltage without any decreasing of voltage. Therefore, P channel MOS transistor PT10 for short-circuit is provided only for the memory cell for data retention.

(Ninth Embodiment)

Figure 19:
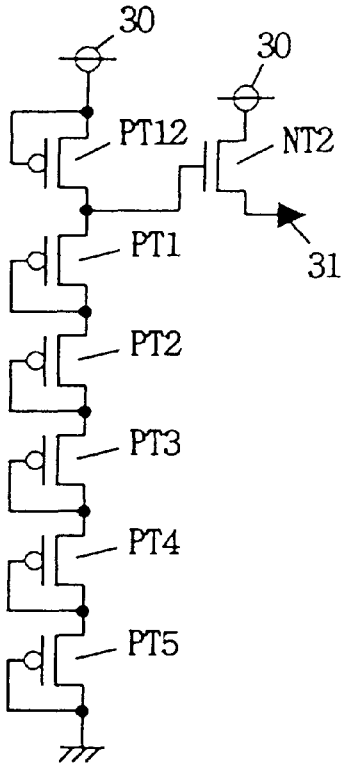
FIG. 19 is a circuit diagram showing a structure of an internal supply voltage generating circuit according to the ninth embodiment of the invention.

FIG. 19 is a circuit diagram illustrating a structure of an internal supply voltage generating circuit according to the ninth embodiment.

As shown in FIG. 19, the internal supply voltage generating circuit of this embodiment has a structure similar to that of the first embodiment except that a P channel MOS transistor PT12 in off state having its drain and gate connected to each other is connected between the gate of N channel MOS transistor NT2 and external supply node 30 instead of the resistance element.

Figure 20:
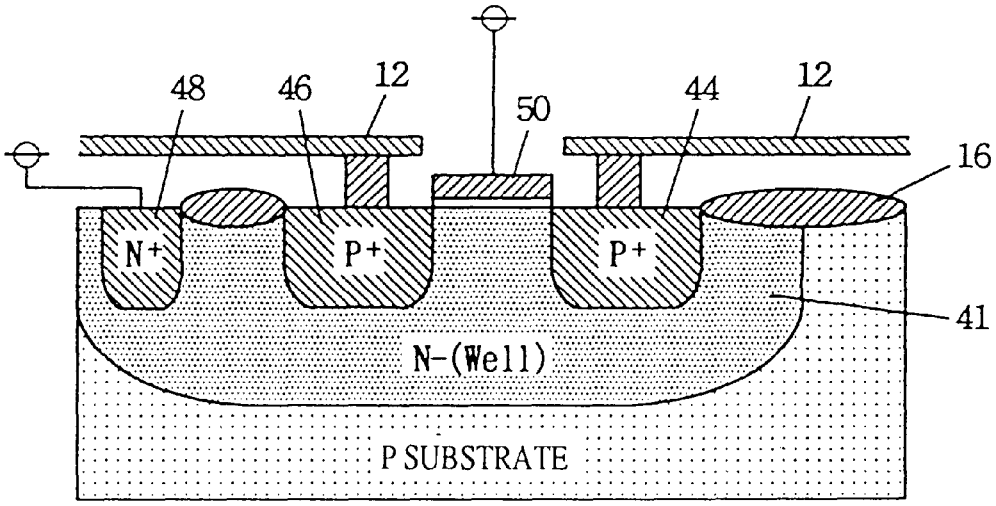
FIG. 20 shows a structure of the P channel MOS transistor in off state shown in FIG. 19.

One example of a structure of P channel MOS transistor PT12 in off state is shown in FIG. 20.

In P channel MOS transistor PT12 shown in FIG. 20, $N^-$ well 41 is formed in a P type substrate. In $N^-$ well 41, impurity region $P^+$ layers 44, 46 and an impurity region $N^+$ layer 48 are formed and metal interconnection 12 is connected to impurity region $P^+$ layers 44, 46. Impurity region $P^+$ layers 44 and 46 respectively correspond to the source and the drain of P channel MOS transistor PT12. A gate 50 is provided between impurity region $P^+$ layers 44 and 46 via an insulating layer, and external supply voltage Vcc is applied to the gate.

In the current SRAM of low power consumption, standby current of the chip is 0.1 μA or less. The resistance element to be used in the internal supply voltage generating circuit according to the present invention should have a resistance value of at least $10^9\Omega$ in order to prevent increase of the standby current. Conventionally, the polysilicon high resistance employed as high resistance load of a memory cell could be utilized in a peripheral circuit such as a voltage down converter. However, a polysilicon high resistance cell is not employed in the current SRAM, and the polysilicon high resistance is not formed on the wafer. In order to utilize the high resistance element in the circuit, additional process for producing high resistance is required only for this purpose, or any other element has to be used as the high resistance element. In the internal supply voltage generating circuit according to this embodiment, P channel MOS transistor PT12 which is turned off is employed as the high resistance element. Even if P channel MOS transistor PT12 is turned off, slight current of a few fA flows therethrough when voltage is applied between the source and the drain. P channel MOS transistor PT12 is thus utilized as high resistance.

Value of this current can be changed by adjusting threshold voltage Vth (PMOS) of P channel MOS transistor PT12. If the flowing current is too small, threshold voltage Vth (PMOS) can be decreased only for P channel MOS transistor PT12 which is turned off.

(Tenth Embodiment)

Figure 21:
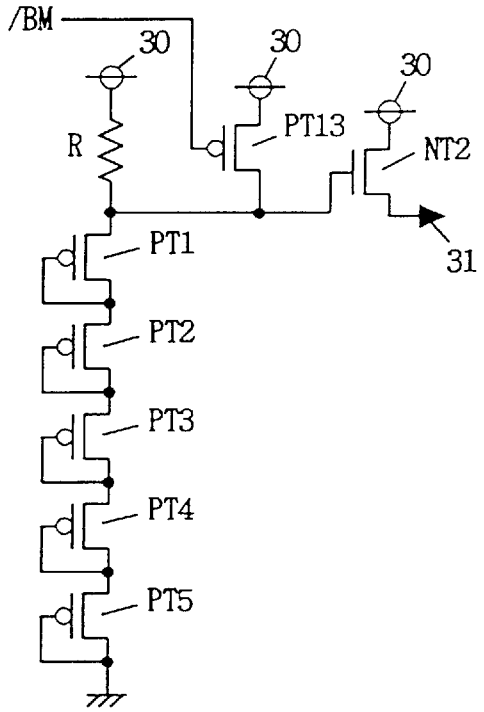
FIGS. 21–25 are circuit diagrams respectively showing structures of internal supply voltage generating circuits according to the tenth to the fourteenth embodiments of the invention.

FIG. 21 is a circuit diagram showing a structure of an internal supply voltage generating circuit according to the tenth embodiment.

As shown in FIG. 21, the internal supply voltage generating circuit of this embodiment has a structure similar to that of the first embodiment, except that a P channel MOS transistor PT13 is further provided connected between the gate of N channel MOS transistor NT2 and external supply node 30, and receiving at its gate the burn-in test signal /BM.

At burn-in test (/BM=L), P channel MOS transistor PT13 is turned on, and external supply voltage Vcc is applied to the gate of N channel MOS transistor NT2.

Accordingly, internal supply voltage can be increased to Vcc−Vth (NMOS) at burn-in test.

(Eleventh Embodiment)

Figure 22:
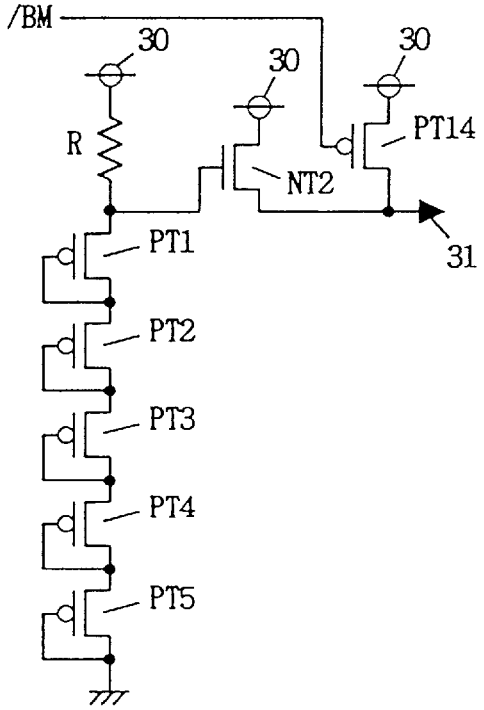

FIG. 22 is a circuit diagram showing a structure of an internal supply voltage generating circuit according to the eleventh embodiment.

As shown in FIG. 22, the internal supply voltage generating circuit according to this embodiment has a structure similar to that of the first embodiment, except that a P channel MOS transistor PT14 is further provided between external supply node 30 and internal supply node 31, and receiving at its gate the burn-in test signal /BM.

In the internal supply voltage generating circuit according to this embodiment, when burn-in test is conducted (/BM=L), P channel MOS transistor PT14 is turned on, and internal supply voltage can be increased to external supply voltage Vcc.

(Twelfth Embodiment)

Figure 23:
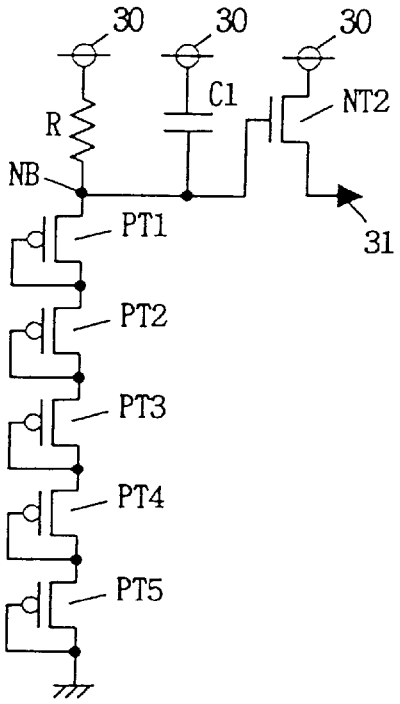

FIG. 23 illustrates a structure of an internal supply voltage generating circuit according to the twelfth embodiment.

FIG. 23 shows that the internal supply voltage generating circuit has a structure similar to the one according to the first embodiment, except that a capacitance C1 is provided between the gate of N channel MOS transistor NT2 and external supply voltage 30.

When external supply voltage increases rapidly, for example, when the power is turned on, gate potential of N channel MOS transistor NT2 increases accordingly, and internal supply voltage soon increases to voltage Vcc−Vth (NMOS). When P channel MOS transistors PT1–PT5 are thereafter turned on, the potential on node NB decreases to Vcc−Vth (NMOS)−$\alpha 1$. In this case, $\alpha 1$ is the voltage across both ends of resistance element R.

Generation of voltage Vcc−Vth (NMOS) as internal supply voltage is not preferable to reliability. However, it causes no problem if generated for a short period. What is more important is to prevent an operation at low internal supply voltage when gate potential of N channel MOS transistor NT2 does not follow external supply voltage, which may possibly result in malfunction in the worst case.

If capacitance C1 is not provided, the gate of N channel MOS transistor NT2 is charged via resistance element R. The charging is very slow since the resistance value of resistance element R is made high for reducing current.

(Thirteenth Embodiment)

Figure 24:
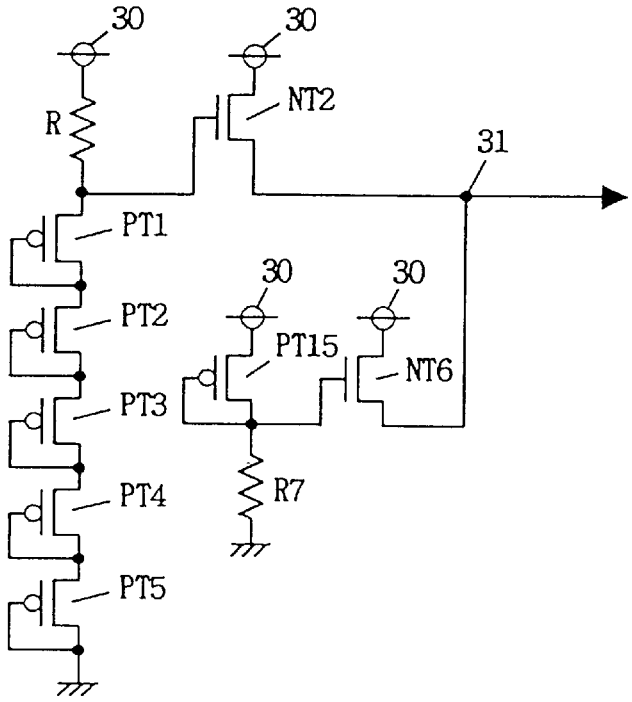

FIG. 24 is a circuit diagram showing an internal supply voltage generating circuit according to the thirteenth embodiment.

As shown in FIG. 24, the internal supply voltage generating circuit has a structure similar to the one according to the first embodiment, except that it includes: an N channel MOS transistor NT6 connected between internal supply node 31 and external supply node 30; a P channel MOS transistor PT15 connected between the gate of N channel MOS transistor NT6 and external supply node 30 and has its gate and drain connected to each other; and a resistance element R7 connected between the gate of N channel MOS transistor NT6 and ground node.

The operation of the internal supply voltage generating circuit of this embodiment is similar to that of the first embodiment, except that voltage Vcc−Vth (PMOS), which is smaller than external supply voltage Vcc by threshold voltage of P channel MOS transistor Vth (PMOS), is applied to the gate of N channel MOS transistor NT6. At this time, voltage Vcc−Vth (PMOS)−Vth (NMOS) is supplied to internal supply node 31 from N channel MOS transistor NT6.

Although a disadvantage of the internal supply voltage applied from N channel MOS transistor NT6 is that it excessively decreases at lower voltages, an advantage is that it increases faster than the internal supply voltage applied from N channel MOS transistor NT2 when external supply voltage rises sharply. This advantage can be obtained by the charging of the gate of N channel MOS transistor NT6 via P channel MOS transistor PT15.

The internal supply voltage generating circuit according to this embodiment thus compensates for the shortcomings of the internal supply voltage generating circuit according to the first embodiment.

(Fourteenth Embodiment)

Figure 25:
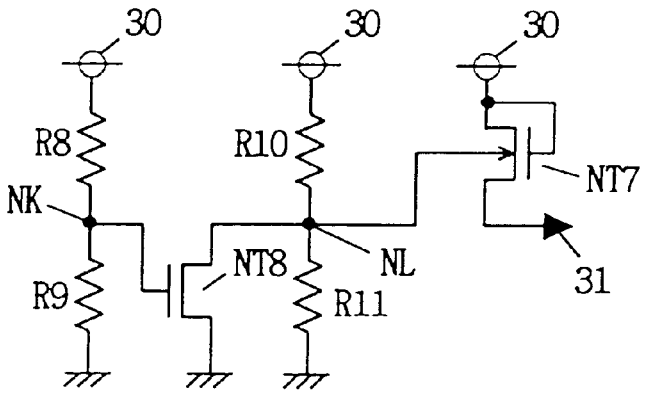

FIG. 25 illustrates a structure of an internal supply voltage generating circuit according to the fourteenth embodiment.

As shown in FIG. 25, the internal supply voltage generating circuit of this embodiment includes: an N channel MOS transistor NT7 connected between external supply node 30 and internal supply node 31, and having its gate and drain connected to each other; a resistance element R10 connected between external supply node 30 and the backgate of N channel MOS transistor NT7; a resistance element R11 connected between the backgate of N channel MOS transistor NT7 and ground node; an N channel MOS transistor NT8 connected between the backgate of N channel MOS transistor NT7 and ground node; a resistance element R8 connected between the gate of N channel MOS transistor NT8 and external supply node 30; and a resistance element R9 connected between the gate of N channel MOS transistor NT8 and ground node.

In the internal supply voltage generating circuit of this embodiment, the amount of decrease in voltage is adjusted by controlling backgate potential of N channel MOS transistor NT7 to vary threshold voltage Vth (NMOS).

Figure 26:
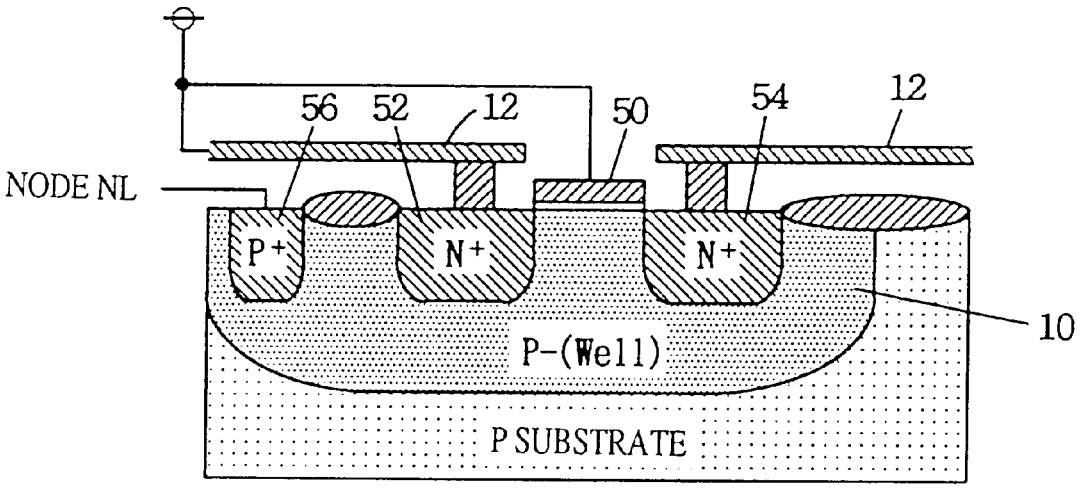
FIG. 26 illustrates a structure of the N channel MOS transistor in FIG. 25 in which backgate potential is controlled.

FIG. 26 illustrates one example of a structure of N channel MOS transistor NT7. FIG. 26 shows that N channel MOS transistor NT7 includes $P^-$ well 10 formed in an N type substrate, and $N^+$ layer impurity regions 52, 54 and $P^+$ layer impurity region 56 in $P^-$ well 10.

$N^+$ layer impurity regions 52 and 54 respectively correspond to source and drain. Gate 50 is provided between $N^+$ layer impurity regions 52 and 54 via an insulating film. $N^+$ layer impurity regions 52 and 54 are respectively connected to metal interconnection 12, and external supply voltage Vcc is applied to gate 50 and source 52.

Figure 27:
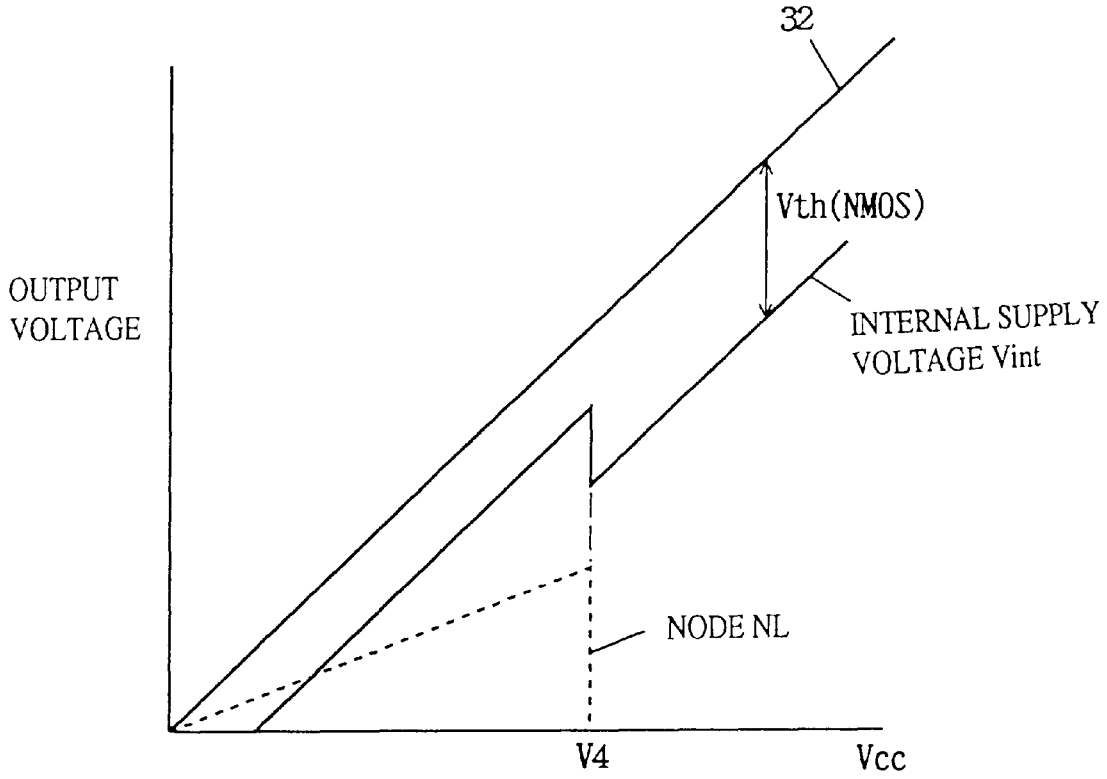
FIG. 27 shows an operation of the internal supply voltage generating circuit shown in FIG. 25.

Next with reference to FIG. 27, an operation of the internal supply voltage generating circuit according to the fourteenth embodiment is described.

Since external supply voltage Vcc is low, if the potential on node NK is lower than threshold voltage Vth (NMOS) of N channel MOS transistor NT8 due to resistance division between resistance elements R8 and R9, N channel MOS transistor NT8 is turned off. The potential on node NL is set at Vcc×R11/(R10+R11) by resistance elements R10, R11, and is proportional to external supply voltage Vcc. At this time, threshold voltage Vth (NMOS) is decreased and the amount of decrease in voltage becomes small by setting the backgate above 0 V (at most the source potential). Specifically, when an external supply voltage is 3 V, internal supply voltage is approximately 2.3 V.

In this case, the ratio between resistances are approximately set to R8:R9=4:1, R10:R11=1:2. If this external supply voltage Vcc is higher than voltage V4, N channel MOS transistor NT8 is turned on, and the potential on node NL becomes 0 V. Accordingly, threshold voltage of N channel MOS transistor NT7 Vth (NMOS) rises, resulting in larger amount of decrease in voltage. For example, when external supply voltage Vcc is 5 V, internal supply voltage is about 3.5 V.

(Fifteenth Embodiment)

Figure 28:
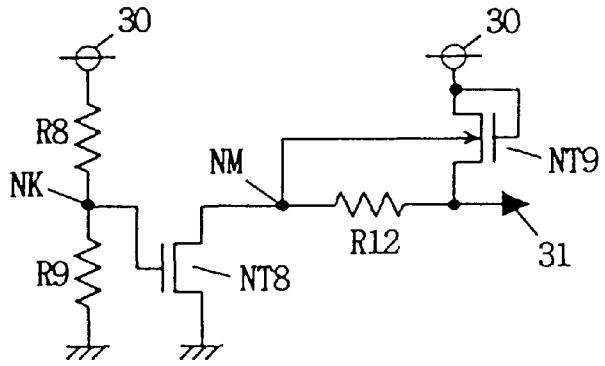
FIG. 28 is a circuit diagram showing a structure of an internal supply voltage generating circuit according to the fifteenth embodiment of the invention.

FIG. 28 shows a structure of an internal supply voltage generating circuit according to the fifteenth embodiment.

As shown in FIG. 28, the internal supply voltage generating circuit includes: an N channel MOS transistor NT9 connected between external supply node 30 and internal supply node 31 and having its gate and drain connected to each other; a resistance element R12 connected between the source and the backgate of N channel MOS transistor NT9; N channel MOS transistor NT8 connected between the backgate of N channel MOS transistor NT9 and ground node; resistance element R8 connected between external supply node 30 and the gate of N channel MOS transistor NT8; and resistance element R9 connected between the gate of N channel MOS transistor NT8 and ground node.

Figure 29:
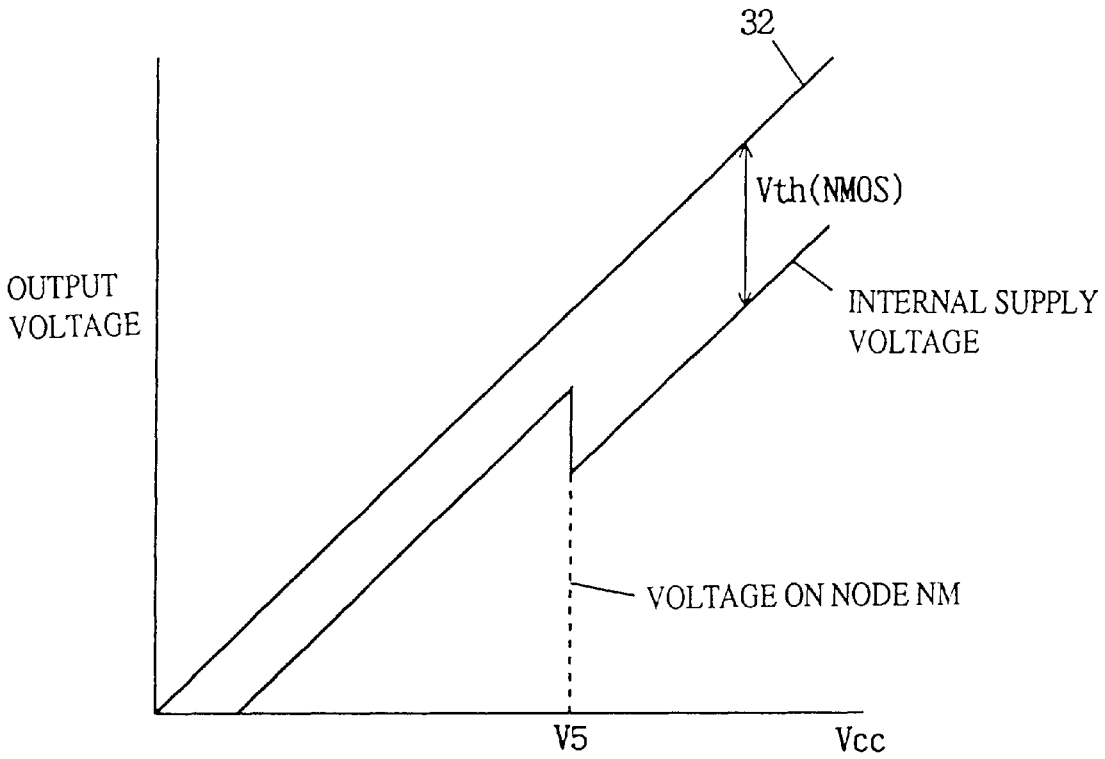
FIG. 29 shows an operation of the internal supply voltage generating circuit in FIG. 28.
Figure 30:
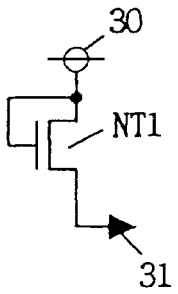
FIG. 30 PRIOR ART
FIG. 30 is a circuit diagram showing a structure of a conventional internal supply voltage generating circuit.
Figure 31:
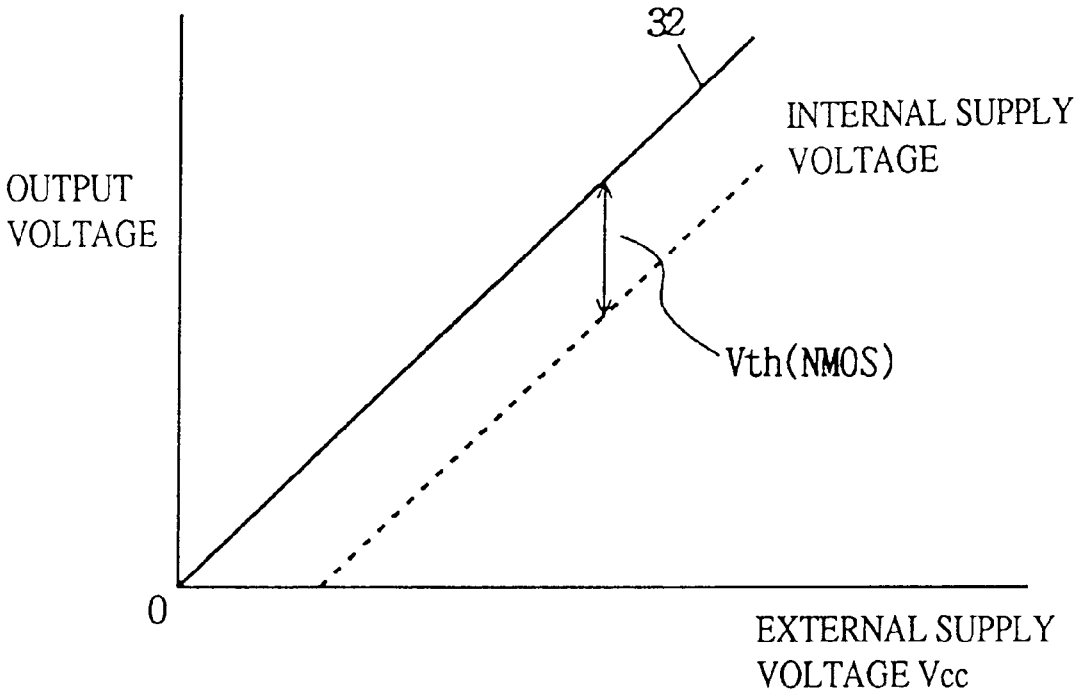
FIG. 31 PRIOR ART
FIG. 31 shows an operation of the internal supply voltage generating circuit shown in FIG. 30.

Next referring to FIG. 29, an operation of the internal supply voltage generating circuit of this embodiment is described.

When external supply voltage is lower than voltage V5, N channel MOS transistor NT8 is turned off, so that the potential on node NM becomes equal to the potential on internal supply node 31. Specifically, backgate potential and source potential of N channel MOS transistor NT9 are identical, and the backgate voltage is 0 V.

At this time, threshold voltage Vth (NMOS) of N channel MOS transistor NT9 is approximately 0.7 V, and if external supply voltage is 3.0 V, internal supply voltage is 2.3 V.

On the other hand, when external supply voltage is higher than voltage V5, N channel MOS transistor NT8 is turned on and the potential on node NM becomes 0 V. At this time, threshold voltage Vth (NMOS) of N channel MOS transistor NT9 is approximately 1.5 V, and if external supply voltage is 5.0 V, internal supply voltage becomes approximately 3.5 V.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal supply voltage generating circuit comprising:

a first N channel MOS transistor connected between an external supply node and an internal supply node;

at least one first resistance element connected between said external supply node and the gate of said first N channel MOS transistor;

at least one diode element connected in series between the gate of said first N channel MOS transistor and a ground node; and an MOS transistor having its source and drain respectively connected to said external supply node and the gate of said first N channel MOS transistor and having its gate receiving an external control signal.

2. An internal supply voltage generating circuit comprising:

a first N channel MOS transistor connected between an external supply node and an internal supply node;

at least one first resistance element connected between said external supply node and the gate of said first N channel MOS transistor;

at least one diode element connected in series between the gate of said first N channel MOS transistor and a ground node;

a second N channel MOS transistor connected between said external supply node and said internal supply node;

a P channel MOS transistor connected between the gate of said second N channel MOS transistor and said external supply node; and having its gate and drain connected to each other; and a second resistance element connected between the gate of said second N channel MOS transistor and said ground node.

3. An internal supply voltage generating circuit comprising:

a first N channel MOS transistor connected between an external supply node and an internal supply node;

at least one first resistance element connected between said external supply node and the gate of said first N channel MOS transistor;

at least one diode element connected in series between the gate of said first N channel MOS transistor and a ground node;

a first P channel MOS transistor connected between said external supply node and said internal supply node;

a second P channel MOS transistor connected between said external supply node and the gate of said first P channel MOS transistor;

a second resistance element connected between the gate of said first P channel MOS transistor and said ground node;

a third resistance element connected between said external supply node and the gate of said second P channel MOS transistor; and a fourth resistance element connected between the gate of said second P channel MOS transistor and said ground node.

4. An internal supply voltage generating circuit provided for a semiconductor memory device including a first internal supply node for applying voltage to a peripheral circuit and a second internal supply node for applying voltage to memory cells, comprising:

a first N channel MOS transistor connected between an external supply node and said first internal supply node;

a first resistance element connected between said external supply node and the gate of said first N channel MOS transistor;

at least one first diode element connected in series between the gate of said first N channel MOS transistor and a ground node;

a second N channel MOS transistor connected between said external supply node and said second internal supply node;

a second resistance element connected between said external supply node and the gate of said second N channel MOS transistor;

at least one second diode element connected in series between the gate of said second N channel MOS transistor and said ground node;

a first P channel MOS transistor connected between said external supply node and said second internal supply node;

a second P channel MOS transistor connected between said external supply node and the gate of said first P channel MOS transistor;

a third resistance element connected between the gate of said first P channel MOS transistor and said ground node;

a fourth resistance element connected between said external supply node and the gate of said second P channel MOS transistor; and a fifth resistance element connected between the gate of said second P channel MOS transistor and said ground node.

5. An internal supply voltage generating circuit, comprising:

a first N channel MOS transistor connected between an external supply node and an internal supply node and having its gate and drain connected to each other;

a second N channel MOS transistor connected between the backgate of said first N channel MOS transistor and a ground node;

a first resistance element connected between the gate of said second N channel MOS transistor and said external supply node; and a second resistance element connected between the gate of said second N channel MOS transistor and said ground node.

* * * * *